United States Patent [19]

Chun-Jung

[11] 4,373,291

[45] Feb. 15, 1983

[54] PLURAL ACROBATIC FIGURES ON A STRING

[76] Inventor: Sun Chun-Jung, 10911 Orleans Way, Kensington, Md. 20795.

[21] Appl. No.: 209,659

[22] Filed: Nov. 24, 1980

[51] Int. Cl.[3] ..... A63H 3/18

[52] U.S. Cl. ..... 46/133

[58] Field of Search ..... 46/133, 126, 62, 63, 46/123, 124

[56] References Cited

U.S. PATENT DOCUMENTS

| | | | |
|---|---|---|---|
| 171,703 | 1/1876 | Smith | 46/133 |
| 590,339 | 9/1897 | Shafer | 46/133 |
| 846,449 | 3/1907 | Brimmer | 46/133 |
| 929,455 | 7/1909 | Lyon | 46/133 |
| 1,296,179 | 3/1919 | Goehring | 46/130 |
| 1,439,634 | 12/1922 | Mosansky | 46/133 |
| 1,476,859 | 12/1923 | Vaughan | 46/130 |
| 1,545,296 | 7/1925 | Wilson | 46/133 |
| 1,629,945 | 5/1927 | Alarcon | 46/133 |
| 2,218,772 | 10/1940 | Sowin | 46/126 |
| 2,352,895 | 7/1944 | Hayes | 46/133 |

FOREIGN PATENT DOCUMENTS

| | | | |
|---|---|---|---|
| 178051 | 4/1954 | Austria | 46/133 |
| 698378 | 6/1964 | Canada | 46/133 |
| 989773 | 5/1951 | France | 46/126 |
| 621905 | 4/1949 | United Kingdom | 46/126 |

OTHER PUBLICATIONS

Family Circle Magazine–11/1/79, pp. 97 and 163.

*Primary Examiner*—F. Barry Shay
*Attorney, Agent, or Firm*—A. Fred Starobin

[57] ABSTRACT

Acrobatic performing figures with two strings passed through either the arms or the legs have the double string passing through hollow posts at double string ends to a rotatable roller and to the same roller at intermediate hollow posts between pairs of figures. The tension at the pivotal points of attachment of the arms and legs to the body of the figures is adjustable.

14 Claims, 5 Drawing Figures

PLURAL ACROBATIC FIGURES ON A STRING

BACKGROUND OF THE INVENTION

This invention relates to toy acrobatic figures with body and limbs hinged together and suspended by a pair of cords or strings wherein by varying the strain on the strings the figures are caused to gyrate as though performing gymnastics.

The prior art has shown many examples of such toy acrobatic figures mostly singly or in groups of two. U.S. Pat. No. 2,352,895 of S. T. Hayes shows three figures and U.S. Pat. No. 929,455 of F. E. Lyon illustrates four figures. In the case of more than two figures there has always been difficulty in applying sufficient variations of strain on the strings to cause all figures to gyrate in unison. The Hayes patent has attempted to solve this difficulty by connecting only two of the figures on one string and the third figure separately. The Lyon patent uses a separate cord for each figure and requires two hand operation or one hand for each pair of puppets.

SUMMARY OF THE INVENTION

The present invention overcomes the difficulties of the prior art by allowing a plurality of figures to be arranged in side by side horizontal arrangement.

This invention also allows a plurality of horizontal arrangements to be stacked above each other.

In the present invention, all arrangements, no matter how many in number, are easily controlled at a single point such as for example by a single knob which controls variations in the string so as to gyrate all figures at the same time.

Additionally in the present invention, the tightness of attachment of the limbs of the figures to the bodies is adjustable so as to allow a variety of movements to take place among the figures during a single gyration of all the figures.

Basically the invention can use a single string, passing through a hole in each of the limbs by which each acrobatic figure is suspended, and then passing downward through hollow posts set between each pair of figures for attachment to a roller mounted for at least partial rotation therebeneath and up through the posts and through another hole in each of the same limbs.

The invention also includes means to vary the acrobatics performed by individual figures in a group by varying the tightness of attachment of the limbs to the body of the figures.

Varying the tightness of limbs may be accomplished by varying the distance between knots on the cords attaching these limbs to the bodies, or in another embodiment by the use of ridged plastic pins for this attachment.

BRIEF DESCRIPTION OF THE DRAWINGS

These as well as further advantages which are inherent in the invention will become apparent from the following description, reference being had to the accompanying drawings wherein.

DESCRIPTION OF THE PREFERRED EMBODIMENTS

Figure 1:
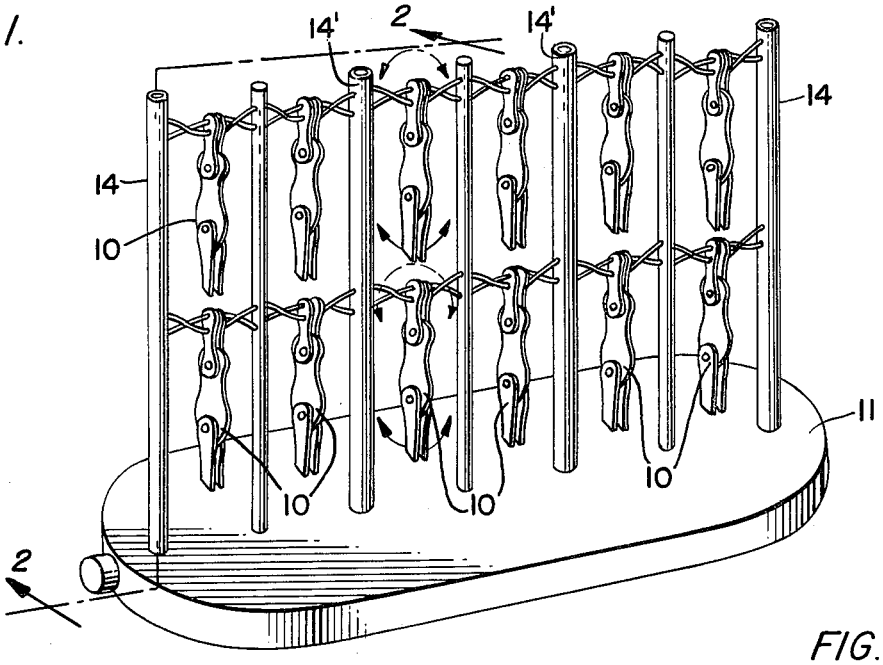
FIG. 1 is an overall perspective of a form of the toy with acrobatic figures on a platform illustrating the present invention.

Referring first to the overall perspective view of the toy of the present invention in FIG. 1 there are shown acrobatic figures 10 which are mounted above a platform 11. Figures 10 can be made to depict either human beings, or animals such as monkeys, performing acrobatics. A string 12 strung with a strand of string 12 throughout, passes with a strand through each one of a pair of holes in each of the limbs, such as for example, arms 13, to suspend the acrobatic figure between posts. In the embodiment shown in FIG. 1, and in more detail in FIG. 2, each figure 10 is suspended between a hollow post 14 or 14' and a solid post 16. Each solid post 16 has through passages 17 and 18, one for each of the strands of string 12. When there are additional horizontal arrangements as in the illustrated embodiment then additional pairs of through passages are spaced up the solid post 16.

The double strand of string 12 is shown as curved between the posts 14 or 14' and 16. This amount of curve depends upon the position of the acrobatic FIG. 10. When the tension on string 12 is increased the curve will tend to disappear thereby gyrating figure 10 to a position above and then over the strings to which it is attached.

The opposite extensions of the portions of string 12 extending from the figures 10 pass through openings in hollow posts 14 or 14'. End posts 14 require only one pair of openings for each horizontal arrangement of figures 10. Intermediate hollow posts 14' have double strands of string 12 approaching from opposite sides and therefore opposing openings are found for each horizontal arrangement. This is clearly shown for hollow post 14' in FIG. 4 as well as in FIG. 2.

Figure 2:
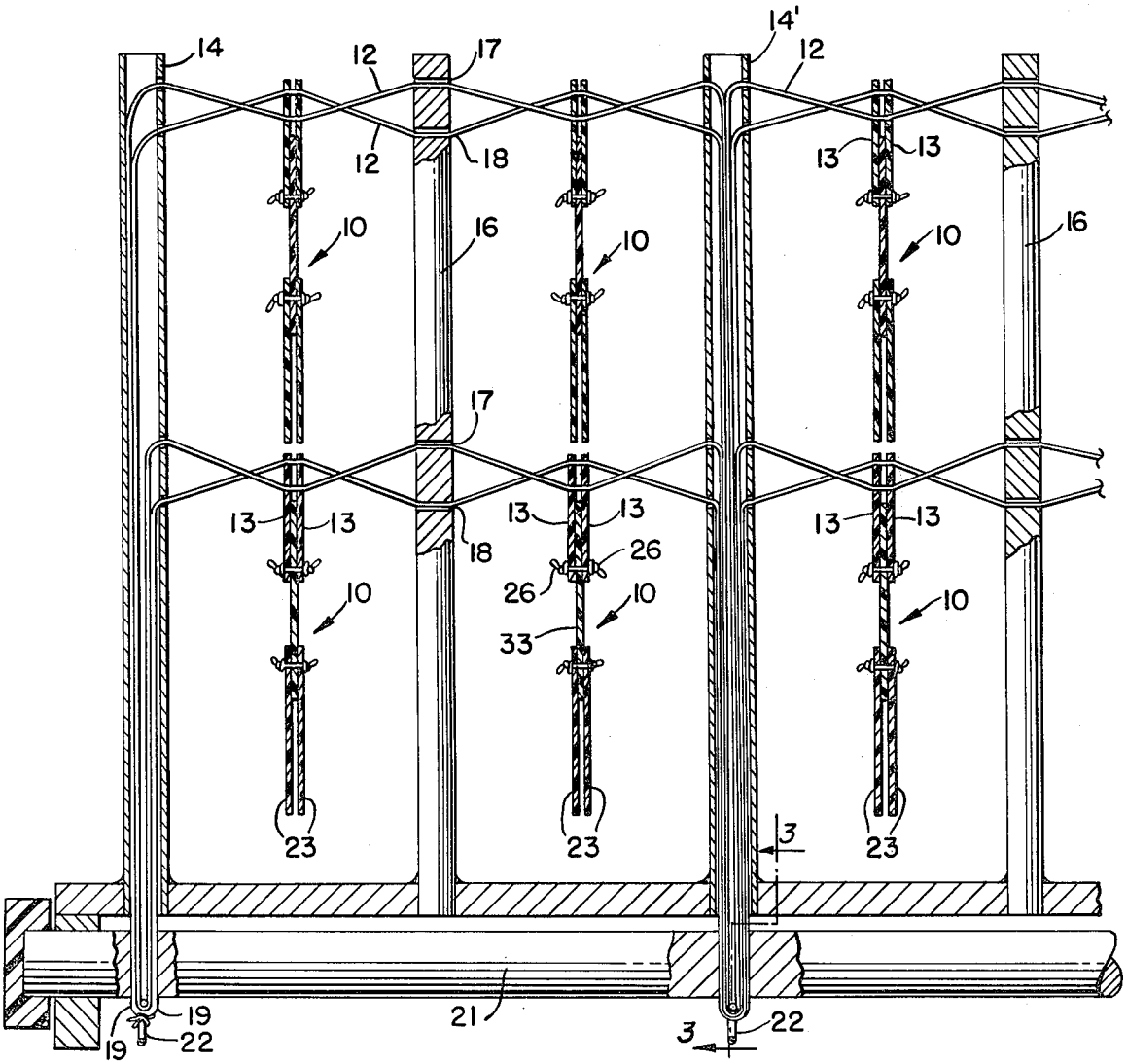
FIG. 2 is a partial sectioned view along line 2—2 of FIG. 1.

String 12 in the preferred embodiment illustrated is a single string connected at its ends 19 to form an endless string. The string 12 is doubled to form a double strand which as shown in FIG. 2 starts a double set of outer strands and a double set of inner strands in hollow post 14 with the outer strands passing out of the upper pair of openings of post 14 to the upper horizontal arrangement and the inner strands passing out of the lower pair of openings of post 14 to the lower horizontal arrangement of acrobatic figures 10. Each of the double strands of string 12 from the openings of post 14 pass through the pairs of openings in the arms of figures 10 and then through either of through passages 17 or 18 in solid post 16 in upper and lower levels and then through openings in the arms of the next supported figures 10. Each double strand enters a pair of openings in intermediate post 14' at upper and lower levels respectively. All four strands then pass downwardly out through the bottom of hollow post 14' for attachment to roller 21.

Figure 3:
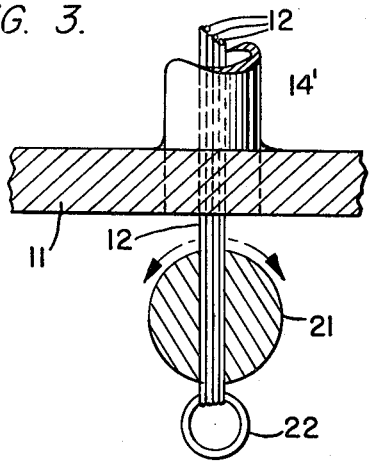
FIG. 3 is an enlarged partially sectioned view along line 3—3 of FIG. 2.

The manner in which the strands of string 12 pass through roller 21 and attachment is made to roller 21 is shown in the enlarged detail of FIG. 3. All of the strands of string 12 passing down through platform 11 from the bottom of intermediate post 14', as well as in the case of hollow end posts 14, pass through an opening through roller 21 and through ring 22. Ring 22 is large enough so that it can not be pulled back through the hole in roller 21 through which the strands of string 12 have been passed. Such ring attachment is made beneath all of hollow posts 14 and 14' including where the string ends 19 are tied. It should be understood that attachment of string 12 to roller 21 can be made in other ways such as by direct attachment to roller 21 but this manner of attachment illustrated is a preferred embodiment with certain advantages. By utilization of a single string throughout with unimpeded redistribution of the string to all parts of the toy, a more equal tensioning of the string takes place allowing a more uniform action of acrobatic figures 10.

Figure 4:
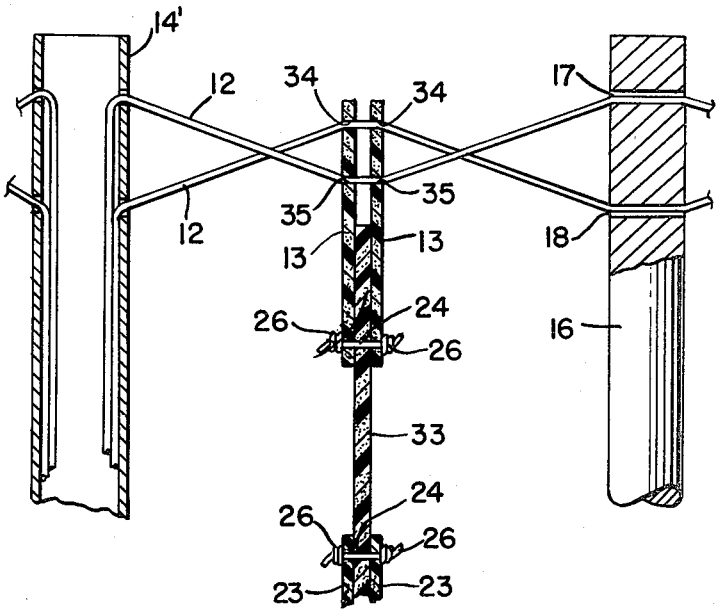
FIG. 4 is an enlarged sectioned view of one of the acrobatic figures attached between two posts.

Although the discussion above concerned means to obtain a uniformity of action, it may be desired to cause selected variations of selected figures from this uniformity. This may be accomplished by the variation of the tightness or pressure of the limbs such as arms 13 and legs 23 against body 33 of acrobatic figures 10. Means of varying this tightness are more clearly illustrated in FIG. 4 with another embodiment of attachment of limbs (legs 23) to body 33 shown in FIG. 5. In FIGS. 1, 2, and 4 the attachment of limbs to body 33 is made by use of a cord 24, which may be a nylon cord, which passes through limbs 12 or 23 and body 33 therebetween and is knotted at its ends by knots 26. The shortness of cord 24 between knots 26 determines the frictional contact between limbs 13 or 23 and body 33 which determines their relative ease of movement and therefore the relative movement of acrobatic figures 10 in performing their acrobatic gyrations in relation to each other.

Figure 5:
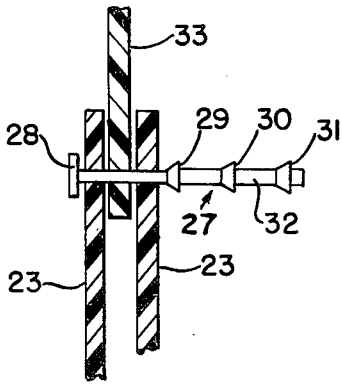
FIG. 5 is an enlarged view showing the use of a plastic pin for attachment of limbs to body of an acrobatic figure.

Instead of the use of cord 24 to attach limbs 13 and 23 to body 33, a plastic pin 27 may be used. Plastic pin 27 which is illustrated in FIG. 5 has a head 28 at one end and spaced ridges 29, 30, and 31 on shaft 32. For less freedom of movement of legs 23 or arms 13 relative to the body 33, both limbs and body ae confined between head 28 and first ridge 29 in actual pressed contact with each other. In FIG. 5 the parts are shown with exaggerated spacing therebetween due to the enlargement for purposes of clarity. For more freedom of movement between body and limbs one leg 23 or arm 13 may be moved between ridges 29 and 30 and the remaining limb would still be in pressed contact with body 33. For a very free movement of acrobatic figure 10, equivalent to a longer segment of cord 24 between knots 26, each of limbs 23 or 13 and body 33 occupy its own space on shaft 32 between head 28 and ridge 29, ridges 29–30, and ridges 30–31.

Other factors have been found to improve the performance of acrobatic figures 10 in the performance of their gyrations.

It has been found that the activity of acrobatic figures is increased and therefore improved by correctly proportioning the distances between holes in hollow posts 14 and 14' and solid posts 16 (viz. through passages 17 and 18) relative to the distances between the holes 34 and 35 in the limbs, illustrated as in arms 13 in FIG. 4. The preferred proportion is that the distance between holes in the posts should equal 1.7 times the distance between holes in the limbs of the acrobatic figures.

Also in order to avoid interference in the gyrations, the legs in the embodiment illustrated measured from their point of attachment to body 33 should be shorter than the distance of their point of attachment measured to the nearest string 12 passing through an arm 13. As can be seen from the drawings this would allow the legs 23 to swing past body 33 and arms 13 during gyrations of acrobatic figures 10 without binding in strings 12.

The acrobatic figures 10 are preferably made from resilient plastic plate material or of cardboard. Other light flat plate-like or sheet material may be used with the primary consideration being the lightness of the material.

Using the construction illustrated and described the length of each horizontal row with the number of figures 10 therein may be greatly expanded. Also this construction allows expansion of the number of horizontal rows beyond the two rows shown for illustrative purposes only.

It will be obvious to those skilled in the art that various changes may be made without departing from the scope of the invention and the invention is not to be considered limited to what is shown in the drawings and described in the specification.

I claim:

1. A toy comprising a plurality of figures each having limbs and body portion with holes through a pair of said limbs, a base having a supporting surface to support said plurality of figures having openings therethrough, at least two hollow posts supported over said openings in said supporting surface with their hollow portions communicating with respective ones of said openings, means rotatably mounted in said base beneath said supporting surface, and a string having a double strand with said double strand connected to said rotatable means and passing from one point of relatively non-rotatable connection to said rotatable means through one of said hollow posts, through said holes in a pair of said limbs of each of said figures, and through another of said hollow posts to a second point of relatively non-rotatable connection with said rotatable means, each strand of said double strand passing through its individual series of holes, each series including a hole in each said post and a hole in each limb of one of said pairs.

2. The toy of claim 1 further characterized by a pair of said figures between said hollow posts, an intermediate post supported on said supporting surface between said hollow posts and having a pair of holes therethrough, said double strand of string having one of each of said strands passing through one of said pair of holes in said intermediate post.

3. The toy of claim 2 further characterized by additional openings in said supporting surface and additional hollow posts supported over said openings in said supporting surface, said double strand passing down each of said additional hollow posts for connection with said rotatable means and up said additional hollow post, entering and exiting from said additional hollow post through pairs of spaced holes oppositely located in the sides of said additional hollow post respectively.

4. The toy of claim 3 further characterized by said at least two hollow posts forming end hollow posts supported on said supporting surface and said additional hollow posts forming posts located on said supporting surface positioned between said end hollow posts, one of said intermediate posts located between each two of said hollow posts and additional hollow posts whereby said hollow posts and said intermediate posts are located on said supporting surface in alternating order positions.

5. The toy of claim 4 further characterized by
a horizontal row of said figures located above said first mentioned figures between said hollow posts and said intermediate posts.

6. The toy of claim 5 further characterized by
said double strand of cord connected as part of said string passing through said upper row of said figures and through upper pairs of holes in said hollow posts and said intermediate posts and passing down said hollow posts for connection with said rotatable means.

7. The toy of claim 6 further characterized by
said rotatable means including a roller mounted for rotation on the underside of said supporting surface.

8. The toy of claim 7 further characterized by
a ring mounted below a passageway in said roller through which said strands of string are passed to connect said strands to said roller below said hollow posts.

9. The toy of claim 8 further characterized by
said string passing through all said figures and said posts and connecting through said rings to said roller being a single string tied together at its ends to form a single continuous length of string.

10. The toy of claim 3 further characterized by
said pairs of holes in said hollow and intermediate posts spaced from each other a distance substantially equal to 1.7 times the distance of spacing of said pairs of holes in said limbs.

11. The toy of claim 2 further characterized by
the length of said limbs on the free end of said figures from their attachment to said body portion being less than the distance from said attachment to the nearest of said holes through said limbs having said string passing therethrough.

12. The toy of claim 1 further characterized by
adjustable means connecting said limbs and body portions whereby said limbs and body portions have a variable compressive frictional force between them.

13. The toy of claim 12 further characterized by
said adjustable means including a cord extending through said connecting limbs and body portions and having knotted ends.

14. The toy of claim 12 further characterized by
said adjustable means including a plastic pin having ridges thereon spaced for predetermined compressive forces on said connecting limbs and body portions.

* * * * *